United States Patent [19]

Fedrick

[11] Patent Number: 4,522,532

[45] Date of Patent: Jun. 11, 1985

[54] BOTTOM-SEATED PORTABLE COFFERDAM AND METHOD OF USE

[76] Inventor: Ronald M. Fedrick, 416 Clearview Pl., Petaluma, Calif. 94952

[21] Appl. No.: 516,741

[22] Filed: Jul. 25, 1983

[51] Int. Cl.[3] ..... E02D 19/04

[52] U.S. Cl. ..... 405/11; 405/195; 405/207; 114/296

[58] Field of Search ..... 405/11-14, 405/207, 208; 114/227, 229, 296, 323, 312

[56] References Cited

U.S. PATENT DOCUMENTS

| | | | |
|---|---|---|---|
| 7,436 | 12/1876 | Lewis . | |
| 924,362 | 6/1909 | Leow . | |
| 1,182,446 | 5/1916 | Barber . | |
| 2,460,624 | 2/1949 | Dobell . | |
| 2,937,006 | 5/1960 | Thayer | 405/207 X |
| 3,348,517 | 10/1967 | Johnson et al. | 114/296 |
| 3,380,256 | 4/1968 | Rebikoff | 405/13 |
| 3,552,129 | 1/1971 | Hooper . | |
| 3,669,055 | 6/1972 | Buce | 114/229 |
| 3,710,579 | 1/1973 | Killmer et al. . | |
| 3,768,265 | 10/1973 | Brouilette . | |
| 3,857,249 | 12/1974 | Kelly et al. . | |
| 3,863,457 | 2/1975 | Halskjold | 405/208 |

FOREIGN PATENT DOCUMENTS

| | | | |
|---|---|---|---|
| 1338500 | 8/1963 | France | 405/207 |
| 1485501 | 9/1977 | United Kingdom | 405/12 |

*Primary Examiner*—Dennis L. Taylor

*Attorney, Agent, or Firm*—Fitch, Even, Tabin & Flannery

[57] ABSTRACT

A bottom-seated portable cofferdam is disclosed along with a method of using the cofferdam for providing working access to underwater surfaces which are generally horizontal. The cofferdam includes a housing having a bottom opening with a skirt extending about its periphery, first and second seal means being secured to the skirt in spaced-apart relation to form a differential pressure chamber open along its bottom. In use, the cofferdam is first positioned adjacent the underwater surfaces, water then being evacuated from the chamber in order to develop a differential pressure therein for urging the cofferdam into engagement with the underwater surfaces. For applications where the underwater surfaces include vertical surface portions, the first and second seals are configured to generally mate with the vertical surface portions as well as the generally horizontal surfaces, evacuation of the differential pressure chamber serving to urge the cofferdam into engagement with the vertical surface portions as well as the generally horizontal surfaces.

27 Claims, 7 Drawing Figures

BOTTOM-SEATED PORTABLE COFFERDAM AND METHOD OF USE

BACKGROUND OF THE INVENTION

The present invention relates to a portable cofferdam and method of use and more particularly to such a cofferdam which is adapted for use on generally horizontal underwater surfaces.

Various cofferdams have been disclosed in the prior art for providing access to submerged surfaces or structures. Most commonly, such cofferdams have been employed for performing maintenance or repairs or other types of work on the submerged surfaces or structures.

Generally, cofferdams are formed with an opening along one surface and are adapted for sealing engagement with the submerged surface or structure. Water may then be pumped from the cofferdam in order to provide access to the surface or structure with which the cofferdam is engaged.

Generally, it has been common practice in the past to position the cofferdam with its open surface adjacent the submerged surface requiring repairs or the like. With the cofferdam so positioned, water is then evacuated or removed from the interior of the cofferdam, the cofferdam being held in place either by external means or partially or entirely by the pressure differential between the interior and exterior of the cofferdam. However, where cofferdams have been secured in place by such differential pressures, they depended entirely on the differential pressure between the exterior of the cofferdam and the entire interior of the cofferdam. Also, where the cofferdam is held in place by such a pressure differential, additional restraining means are necessary to secure the cofferdam while its interior is being evacuated. With all such cofferdams, sealing means were provided about the periphery of the cofferdam for sealing engagement with the submerged surface or structure.

In any event, most such cofferdams have been relatively difficult to install upon the submerged surfaces or structures partly because of the difficulty of positioning the cofferdam and securing it in place while water is evacuated from its interior. The use of such cofferdams in the past has thus been relatively expensive and time-consuming.

Accordingly, there has been found to remain a need for a portable cofferdam for providing working access to underwater surfaces where the cofferdam is relatively easy to install and evacuate. More particularly, there has been found to remain a need for a bottom-seated portable cofferdam to provide working access for underwater surfaces which are generally horizontal.

SUMMARY OF THE INVENTION

It is therefore an object of the present invention to provide a bottom-seated portable cofferdam and method for using such a cofferdam to provide working access for underwater surfaces which are generally horizontal.

More particularly, it is an object of the invention to provide such a bottom-seated portable cofferdam which comprises a housing having a bottom opening for permitting access to the underwater surfaces, skirt means extending generally horizontally about the periphery of the housing with first and second seal means being secured to the skirt means in spaced-apart relation for forming a differential pressure chamber open along its bottom for engagement with the underwater surfaces.

It is a related object to provide a method of using such a cofferdam wherein water is evacuated from the differential pressure chamber after the cofferdam has been lowered onto the underwater surfaces in order to develop a differential pressure in the chamber for urging the cofferdam into engagement with the underwater surfaces.

With a cofferdam including such a combination of features, it is thus possible to initially position the cofferdam upon the underwater surfaces. Water is then evacuated from the differential pressure chamber relatively rapidly so that the differential pressure developed between the chamber and the underwater environment serves to maintain the cofferdam in place while water is evacuated from the interior or working chamber of the cofferdam. The differential pressure chamber also provides a means by which any water tending to enter the cofferdam can be readily removed from the differential pressure chamber by pumps or other means without interfering with operations being carried out in the interior or working chamber of the cofferdam.

It is also an object of the invention to provide such a cofferdam and method of use in connection with underwater surfaces which include vertical surface portions. In such an event, the first and second seal means as well as the skirt if necessary are preferably configured to mate with the perpendicular surface portions as well as the generally horizontal surfaces. When water is then evacuated from the differential pressure chamber, the cofferdam is urged into engagement both with the vertical surface portions as well as the generally horizontal surfaces.

Preferably, the differential pressure chamber for the cofferdam is divided into segments. Water can then be selectively evacuated from the separate segments in order to facilitate installation of the cofferdam. For example, where the underwater surfaces include vertical surface portions, segments of the differential pressure chamber adjacent the vertical surface portions are evacuated first so that the cofferdam is urged into engagement with the vertical surface portions. Thereafter, water may also be evacuated from the segments of the differential pressure chamber which are adjacent the generally horizontal surface portions so that the cofferdam is also urged into engagement with those surfaces.

Additional objects and advantages of the invention are made apparent in the following description having reference to the accompanying drawings.

DESCRIPTION OF THE PREFERRED EMBODIMENT

Figure 2:
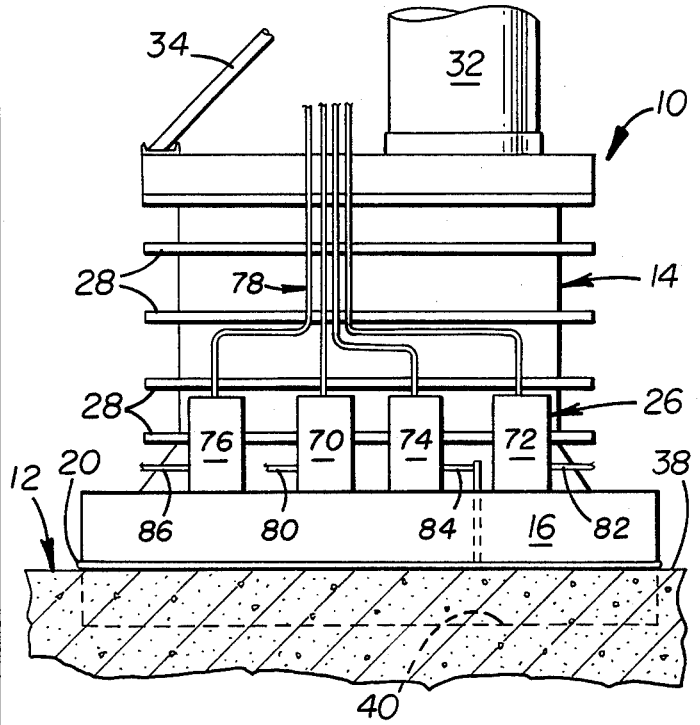
FIG. 2 is a side view in elevation taken along section line 2—2 of FIG. 1.
Figure 1:
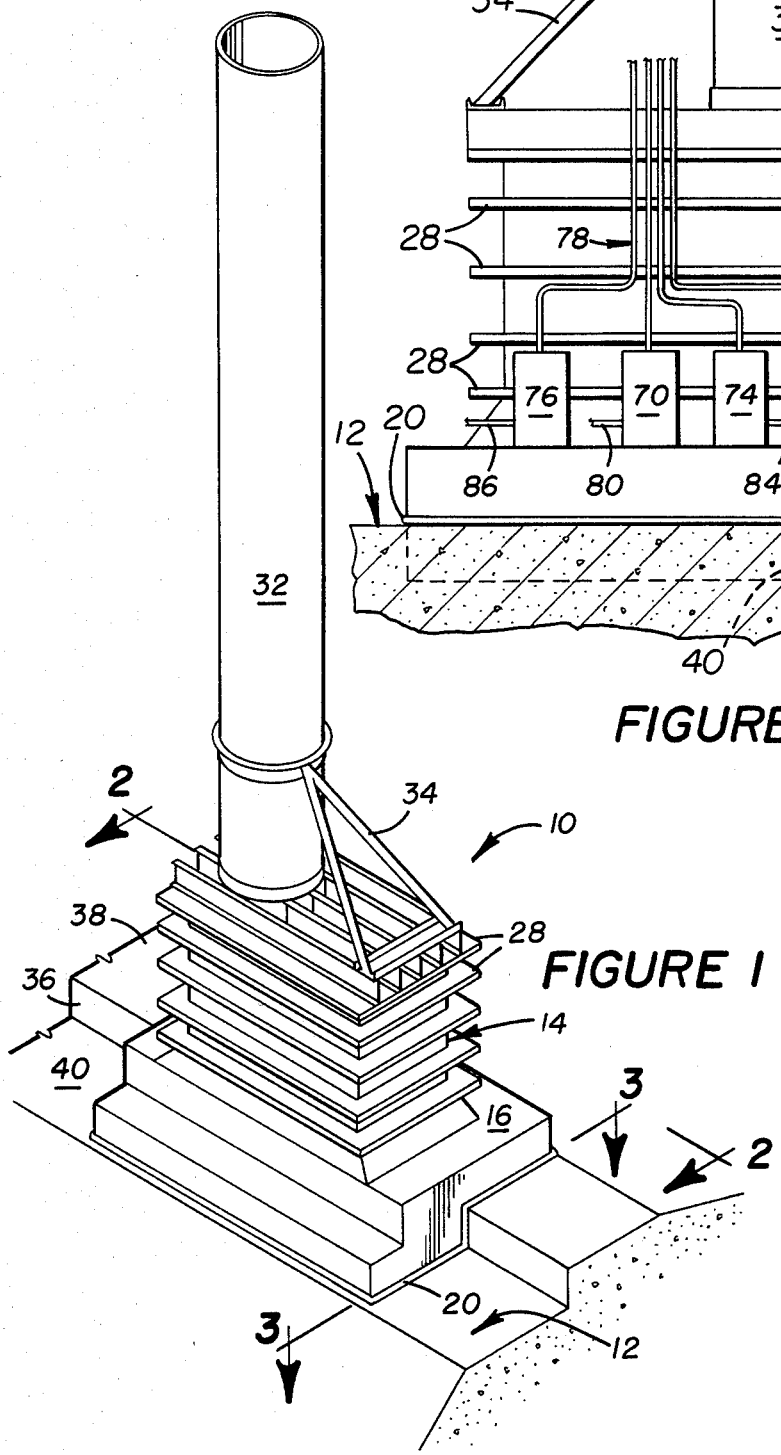
FIG. 1 is a perspective view of the bottom-seated portable cofferdam of the present invention installed in place upon stepped underwater surfaces including both vertical and generally horizontal surface portions.

The present invention is directed toward a bottom-mounted portable cofferdam as generally indicated at 10 in FIGS. 1 and 2 as well as a method of use for such a cofferdam to provide working access to underwater surfaces as generally indicated at 12.

Basically, the cofferdam 10 includes a housing 14 forming working environment within its interior while being open at the bottom for permitting access to the underwater surfaces 12. A fabricated platform 16 surrounds the base of the housing 14 and includes a horizontal plate or skirt 18 extending about the periphery of the housing.

Figure 5:
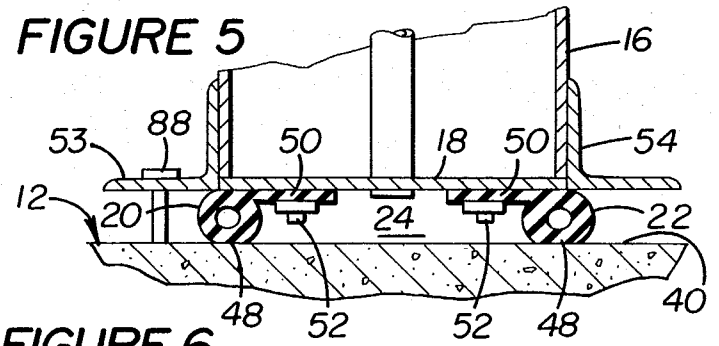
FIG. 5 is a fragmentary view taken along section line 5—5 of FIG. 3 in order to better illustrate the manner in which the differential pressure chamber is formed for the cofferdam of the present invention.
Figure 6:
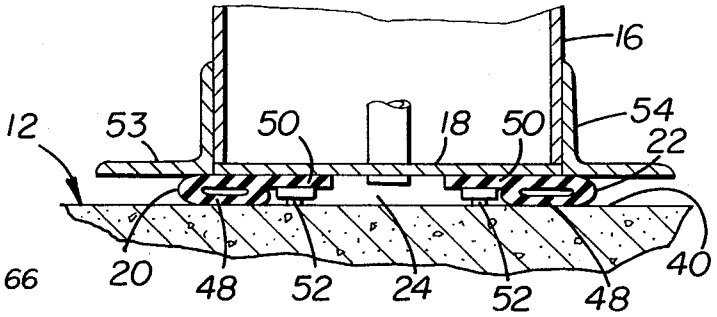
FIGS. 6 and 7 are similar views as FIG. 5 but under different operating conditions, FIG. 6 illustrating a condition after initial evacuation of the differential pressure chamber and FIG. 7 illustrating a condition after subsequent evacuation of the cofferdam interior.

Referring also to FIG. 5, first and second seals 20 and 22 are secured to the skirt 18 in spaced-apart relation. The seals 20 and 22 together with the skirt 18 form a downwardly opening differential pressure chamber 24 adapted for engagement with the underwater surfaces 12 in a manner described in greater detail below. However, it is to be understood that the differential pressure chamber 24 may be evacuated by means such as those also described below in order to develop a differential pressure between the chamber 24 and the surrounding underwater environment for urging the cofferdam into engagement with the underwater surfaces. With the cofferdam so engaged with the underwater surfaces, water can then be readily removed or evacuated from the interior of the housing 14 in order to permit maintenance, repair or other work to be carried out on the underwater surfaces 12 within the housing 14. The differential pressure chamber 24 is preferably evacuated by pump means generally indicated at 26 in FIG. 2.

Figure 3:
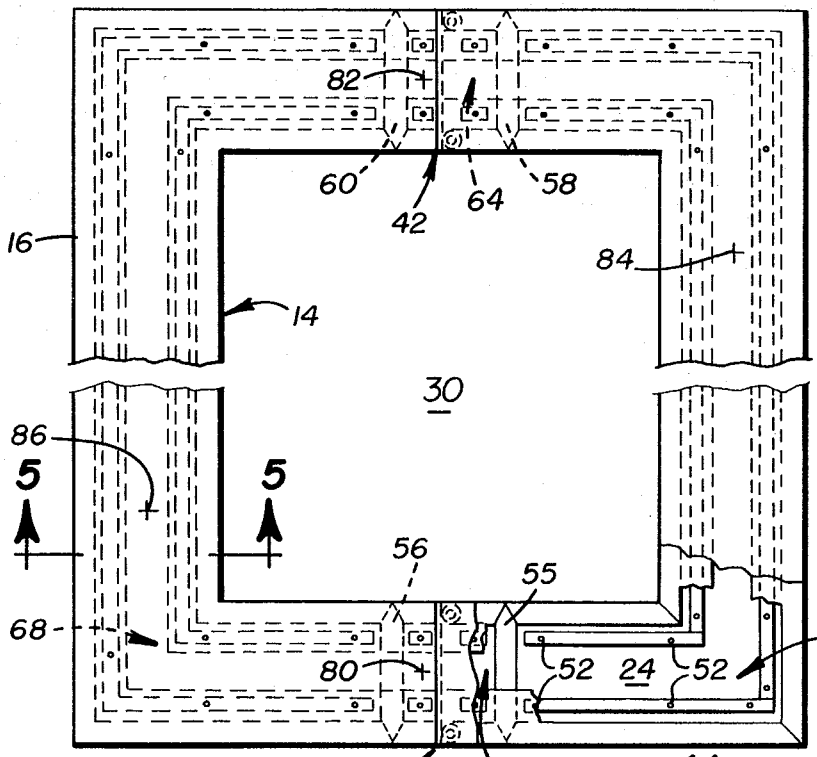
FIG. 3 is a plan view, with parts in section, taken along section line 3—3 of FIG. 1.

To describe the cofferdam in greater detail, the housing 14 is formed from fabricated plate with reinforcing channel 28. Referring particularly to FIG. 3, the housing 14 is formed with an opening 30 at its base for providing working access to the underwater surfaces 12.

With the housing 14 positioned in a selected underwater environment, access to the housing is provided by means of a tube 32 extending upwardly from the housing toward the surface of the water. The tube is preferably formed as a separate structure from the housing and is secured to the housing while being reinforced by means of a brace structure 34.

The fabricated platform 16 as well as the skirt 18 and the seals 20 and 22 are preferably configured for conforming with the underwater surfaces 12 upon which the cofferdam is to be located. Generally, the cofferdam is contemplated for use in a number of different applications, for example where repairs, maintenance or other work is to be performed on underwater surfaces in drydocks, outer locks or in connection with other submerged horizontal surfaces or structures. The underwater surfaces 12 illustrated in FIGS. 1 and 2 are typical of a drydock in the form of a step with a vertical surface portion 36 and upper and lower horizontal surfaces 38 and 40. It is contemplated that repairs are typically necessary along the upper horizontal surface 38 adjacent the vertical stepped surface 36.

As noted above, the platform 16 as well as the skirt 18 and seals 20 and 22 are configured to mate with the upper and lower horizontal surfaces 38 and 40 as well as the vertical surface portions 36. As may be best seen in FIGS. 1, 2 and 5, the platform 16 is formed as a fabricated structure to facilitate access to the differential pressure chamber 24 for evacuating water therefrom as will be discussed in greater detail below.

Figure 4:
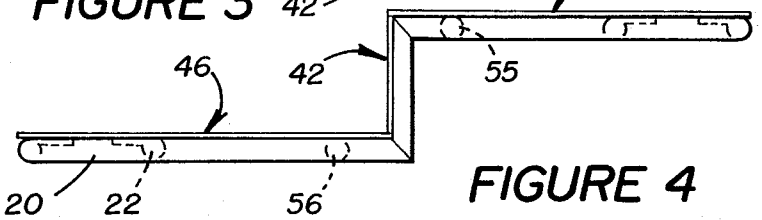
FIG. 4 is a side view of the structure illustrated in FIG. 3 which forms the differential pressure chamber of the invention.

Referring particularly to FIGS. 3 and 4, the skirt 18 as well as the first and second seals 20 and 22 are formed with a step generally indicated at 42 (see FIG. 4) for mating with the vertical surface portion 36. Horizontal portions 44 and 46 for the skirt and first and second seals similarly mate with the upper and lower horizontal surfaces 38 and 40.

Referring particularly to FIG. 5, each of the first and second seals 20 and 22 is preferably formed from elastomeric material and includes an elongated annular seal portion 48 and a flange portion 50 permitting the seals to be secured to the skirt 18 in sealed relation by means of fasteners 52. As may also be seen in FIG. 5, structural flanges 54 and 56 are also secured to the bottom of the platform 16 along its outer and inner edges respectively to provide protection for the seals 20 and 22 and also to provide auxiliary or safety hold-down means as described in greater detail below. The flanges 54 and 56 are omitted in FIGS. 1–4 for simplicity and to permit illustration of the outer seal 20.

As may be best seen in FIG. 3, the first and second seals 20 and 22 extend along the length of the skirt 18 about the periphery of the cofferdam and housing 14. The first and second seals are interrupted by spacers which extend between the first and second seals on opposite sides of each intersection between the seals and the vertical surface portion 36. For example, referring particularly to FIGS. 3 and 4, a first spacer 55 extends between first and second seals in engagement with the upper horizontal surface 38 while another spacer 56 extends between the first and second seals adjacent the lower horizontal surface 40. Similar spacers 58 and 60 are arranged between the first and second seals toward the back of the housing also adjacent the vertical surface portion 36.

Referring particularly to FIG. 3, the spacers 54–60 divide the differential pressure chamber 24 into four segments. First and second chamber segments 62 and 64 are in engagement with the vertical surface portion 36 while the third chamber segment 66 engages the upper horizontal surface 38, the fourth chamber segment 68 engaging the lower horizontal surface 40. These various segments of the differential pressure chamber 24 can thus be evacuated in a predetermined order in order to better facilitate the installation of the cofferdam as described in greater detail below.

Referring again momentarily to FIG. 2, the pump means 26 preferably includes four pumps 70, 72, 74 and 76 for respectively evacuating the first, second, third and fourth differential pressure chamber segments 62–68. The pumps have outlets collectively indicated at 78 which extend to the surface of the water. In addition, each of the pumps has an inlet in communication with its respective differential pressure chamber segment. The first pump 70 has an inlet 80 which is in communication with the first chamber segment 62. The second pump 72 has an inlet 82 in communication with the second differential pressure chamber segment 64. The third pump 74 has an inlet 84 in communication with the third chamber segment 66 while the fourth pump 76 has an inlet 86 in communication with the fourth chamber segment 68. The locations at which the inlets are in communication with the respective chambers are indicated by corresponding numerical labels in FIG. 3. In addition, the inlet for the third chamber segment 66 is also illustrated in FIG. 5. As may be seen there, the third inlet 84 extends downwardly through the fabricated platform 16 and through the skirt 18 in sealed relation for communication with the respective chamber segment. The other inlets 80, 82 and 86 are similarly interconnected with their respective chamber segments. The pumps 70–76 could of course also be located on the surface and placed in similar communication with the respective chamber segments 62–68.

Accordingly, it may be seen that the cofferdam 10 as illustrated in the drawings is particularly adapted for the underwater surfaces illustrated in FIGS. 1 and 2. However, it will also be apparent that the cofferdam of the present invention could also be configured for mating with other underwater surfaces or structures.

Other modifications in the cofferdam of the present invention are believed apparent from the preceding description of the cofferdam and the following description of its method of use.

In use, the bottom-seated portable cofferdam 10 is assembled and lowered into contact with the underwater surface by a winch (not shown) or the like. Guy lines (also not shown) may be employed for guiding the cofferdam into place and may also be used for example toward the upper end of the access tube 32 for interconnection with adjacent caissons (not shown) in order to stabilize the cofferdam, particularly while it is being secured into place.

Once the cofferdam is in place as generally illustrated in FIG. 1, it can be mechanically secured to the underwater surfaces for example by expansion bolts connected between the flanges 54 or 56 and the underwater surfaces, as indicated at 88 in FIG. 5. These hold-down or anchor bolts may be spaced about the cofferdam when it is initially positioned in order to assure that the cofferdam remains in place during subsequent evacuation of water from the differential pressure chamber 24 and interior working chamber of the housing 14. In addition, the hold-down bolts may be used to provide additional safety even after evacuation of the cofferdam and during performance of work in the cofferdam. However, as will be discussed in greater detail below, evacuation of the differential pressure chamber 24 and the differential pressure developed between the chamber 24 and the underwater environment is sufficient to secure the cofferdam in place.

Once the cofferdam is in place, the differential pressure chamber 24 is evacuated for example by the pump means 26 in order to develop a pressure differential between the chamber 24 and the surrounding underwater environment for urging the cofferdam into engagement with the underwater surfaces and thus securing the cofferdam in place.

Preferably, the chamber 24 is divided into segments which may be selectively evacuated in order to facilitate positioning of the cofferdam. As illustrated in FIGS. 3 and 4, the chamber 24 is divided into segments with certain of the segments as illustrated at 62 and 64 being adjacent the vertical surface portion 36.

With such an underwater surface configuration, the differential pressure chamber segments adjacent the vertical surface portions are first evacuated in order to assure that the cofferdam is urged into sealing engagement with the vertical surface portion 36. Thereafter, the other chamber segments, for example those indicated at 66 and 68 (see FIG. 3) are then evacuated in order to urge the entire periphery of the cofferdam into engagement with the underwater surfaces.

With the pump arrangement illustrated in FIG. 2 as described above, the pumps 70–76 are selectively operated for evacuating the various chamber segments in the manner described above.

After the entire differential pressure chamber has been evacuated about the periphery of the cofferdam, water is then evacuated from the interior or working chamber of the cofferdam housing. This evacuation step may be accomplished by suitable means (not shown) such as a pump similar to those indicated at 70–76.

In carrying out the evacuation steps described above, both the area and pressure differential developed within the differential pressure chamber 24 relative to the surrounding water environment are carefully selected in order to assure that adequate hold-down forces are developed for securing the cofferdam in place.

In this regard, FIG. 5 generally illustrates the seals 20 and 22 in their configuration when the cofferdam is initially positioned without any evacuation of water from the differential pressure chamber 24.

Thereafter, as water is evacuated from the chamber 24, the seals 20 and 22 are compressed so that the effective volume of the chamber 24 is decreased. The pressure differential developed at this point is substantially greater than that required to secure the cofferdam in place because of additional buoyancy forces developed when water is evacuated from the interior of the housing.

Figure 7:
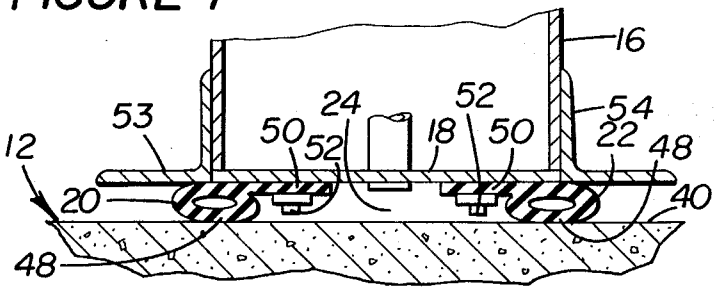

As water is subsequently evacuated from the housing interior, additional buoyancy developed within the cofferdam tends to urge the cofferdam upwardly against the differential pressure forces developed within the chamber 24. Accordingly, when water is entirely evacuated form the housing interior, the volume of the chamber 24 is again relatively increased as illustrated in FIG. 7. However, the seals 20 and 22 remain at least partially compressed in order to assure that they are in sealing engagement with the underwater surfaces.

During use of the cofferdam for repair work, maintenance or the like, operation of the pumps 70–76 is preferably continued in order to evacuate any water which may appear in the chamber 24, for example due to leakage. However, due to the design of the cofferdam of the present invention, it will be apparent that such leakage will not result in water entering the working chamber formed by the housing 14. Thus, the differential pressure chamber 24 also serves to provide better working conditions within the housing 14.

With the cofferdam 10 in place as illustrated in FIG. 1 and after both the differential pressure chamber 24 and the housing interior have been evacuated, workers may enter the housing 14 through the access tube 32 in order to carry out any maintenance work or the like as desired.

Thereafter, the cofferdam can be readily moved to a new working position by merely flooding the interior of the housing and the chamber 24. Any guy lines and/or hold-down bolts used are then released and the cofferdam moved to a new position whereupon the above steps are repeated in order to secure the cofferdam in place.

Accordingly, there has been disclosed a novel bottom-seated portable cofferdam and a method for using the cofferdam in order to facilitate working access to underwater surfaces or structures. Various modifications are believed apparent in addition to those described above. Accordingly, the scope of the invention is defined only by the following appended claims.

What is claimed is:

1. A bottom-seated portable cofferdam for providing working access to underwater surfaces which are generally horizontal, comprising a housing having a bottom opening for permitting access to the underwater surfaces, skirt means extending generally horizontally about the periphery of the housing, and first and second seal means each arranged about the periphery of the housing and operatively secured to the skirt means in spaced-apart relation to each other for forming together a differential, pressure chamber open along its bottom and extending about the periphery of the housing, the first and second seal means being generally flexible for mating with the underwater surfaces.

2. The bottom-seated cofferdam of claim 1 further comprising means for evacuating water from the differential pressure chamber when the cofferdam is positioned on the underwater surfaces in order to develop a differential pressure in the chamber for urging the cofferdam into engagement with the underwater surfaces.

3. The bottom-seated cofferdam of claim 2 further comprising means for evacuating water from the housing interior, the dimensions and differential pressure in the chamber being selected for maintaining the cofferdam against the underwater surfaces during and after evacuation of water from the housing interior.

4. The bottom-seated cofferdam of claim 1 further comprising means proreeding to the housing interior from the surface of the water.

5. The bottom-seated cofferdam of claim 3 wherein said access means comprises a tube extending upwardly from the housing to the water surface.

6. The bottom-seated cofferdam of claim 2 wherein the means for evacuating water from the differential pressure chamber comprises a pump.

7. The bottom-seated cofferdam of claim 2 wherein the differential pressure chamber is divided into segments, the means for evacuating water from the differential pressure chamber comprising separate pump means in communication with respective segments for selectively evacuating water therefrom.

8. The bottom-seated cofferdam of claim 1 wherein the first and second seal means are formed from resilient material which tends to compress and reduce the volume of the differential pressure chamber as water is evacuated from the differential chamber.

9. The bottom-seated cofferdam of claim 8 wherein the seal means are of annular shape and include flange means adapted for attachment to the housing skirt.

10. The bottom-seated cofferdam of claim 8 further comprising resilient spacers interconnecting the spaced-apart seal means for dividing the differential pressure chamber into segments.

11. The bottom-seated cofferdam of claim 10 wherein the means for evacuating water from the differential pressure chamber comprises pump means in respective communication with the segments for selectively evacuating water therefrom.

12. The bottom-seated cofferdam of claim 1 being adapted for engagement with underwater surfaces including vertical surface portions, the first and second seal means being configured to mate with the vertical surface portions as well as the generally horizontal surfaces.

13. The bottom-seated cofferdam of claim 12 further comprising sealing spacers interconnecting the first and second seal means on opposite sides of each vertical surface portions.

14. The bottom-seated cofferdam of claim 13 wherein the means for evacuating water from the differential pressure chamber comprises pump means in respective communication with the segments for selectively evacuating water therefrom.

15. The bottom-seated cofferdam of claim 14 wherein the pump means are selectively operable for initially evacuating water from the chamber segments adjacent the vertical surface portions and then from chamber segments adjacent generally horizontal surface segments.

16. The bottom-seated cofferdam of claim 15 further comprising separate pumps in communication with respective chamber segments.

17. In a method for employing a bottom-seated portable cofferdam for providing a working access to underwater surfaces which are generally horizontal, the steps comprising forming the cofferdam to include a housing having a bottom opening for permitting access to the underwater surfaces, skirt means extending generally horizontally about the periphery of the housing with first and second seal means each being arranged about the periphery of the housing and operatively secured to the skirt means in spaced-apart relation to each other for defining a differential pressure chamber open along its bottom and extending about the periphery of the housing, the first and second seal means being generally flexible for mating with the underwater surfaces, positioning the cofferdam adjacent the underwater surfaces, and evacuating water from the differential pressure chamber in order to develop a differential pressure therein for urging the cofferdam into engagement with the underwater surfaces.

18. The method of claim 17 further comprising the step of subsequently evacuating water from the housing interior, the dimensions and differential pressure in the differential pressure chamber being selected for maintaining the cofferdam against the underwater surfaces during and after evacuation of water from the housing interior.

19. The method of claim 17 further comprising access means between the housing interior and the surface of the water.

20. The method of claim 17 further comprising the step of dividing the differential pressure chamber into separate segments and selectively evacuating water from the segments.

21. The method of claim 17 wherein the first and second seal means are formed from resilient material which tends to compress and reduce the volume of the differential pressure chamber as water is evacuated therefrom.

22. The method of claim 21 wherein the first and second seal means are of annular shape and include flange means adapted for attachment to the housing skirt.

23. The method of claim 22 further comprising resilient spacers interconnecting the spaced-apart first and second seal means to divide the differential pressure chamber into segments.

24. The method of claim 23 further comprising the step of selectively evacuating water from the respective segments.

25. The method of claim 17 wherein the underwater surfaces include vertical surface portions, the first and second seal means being configured to mate with the vertical surface portions as well as the generally horizontal surfaces.

26. The method of claim 25 further comprising sealing spacers interconnecting the first and second seal means and forming a separate differential pressure chamber segment for each vertical surface portion.

27. The method of claim 26 wherein the differential pressure chamber segments adjacent the vertical surface portions are first evacuated in order to urge the cofferdam into engagement with the vertical surface portions, the remaining differential pressure chamber segments adjacent generally horizontal surface portions then being evacuated.

* * * * *